US006065769A

United States Patent [19]

Simonetti et al.

[11] Patent Number: 6,065,769

[45] Date of Patent: May 23, 2000

[54] FOOTWEAR WITH A RELEASABLE PIN FOR USE IN GLIDING SPORTS

[75] Inventors: Luigi Simonetti, Taio Trento; Alessandro Condini, Villazzano Trento, both of Italy

[73] Assignee: Skis Rossignol SA, Voiron, France

[21] Appl. No.: 08/952,224

[22] PCT Filed: Jun. 7, 1996

[86] PCT No.: PCT/FR96/00859

§ 371 Date: Nov. 17, 1997

§ 102(e) Date: Nov. 17, 1997

[87] PCT Pub. No.: WO96/41547

PCT Pub. Date: Dec. 27, 1996

[30] Foreign Application Priority Data

Jun. 8, 1995 [FR] France ..... 95 07022

[51] Int. Cl.[7] ..... A63C 9/20

[52] U.S. Cl. ..... 280/615; 280/613; 36/117.1

[58] Field of Search ..... 280/614, 615, 280/613, 633, 11.3, 11.31, 11.33, 634; 36/117.1, 117.2, 117.3

[56] References Cited

U.S. PATENT DOCUMENTS

| | | |
|---|---|---|
| 4,907,353 | 3/1990 | Wittman et al. . |
| 4,930,233 | 6/1990 | Provence . |

FOREIGN PATENT DOCUMENTS

| | | |
|---|---|---|
| 2533421 | 3/1984 | France . |
| 2626448 | 4/1989 | France . |
| 8805271 | 7/1988 | WIPO . |

*Primary Examiner*—Richard M. Camby
*Attorney, Agent, or Firm*—Wall Marjama Bilinski & Burr

[57] ABSTRACT

A boot suitable for use in association with various sports related gliding devices having a stirrup embedded in the sole of the boot containing a pair of opposed arms for removably supporting a pin therebetween.

13 Claims, 7 Drawing Sheets

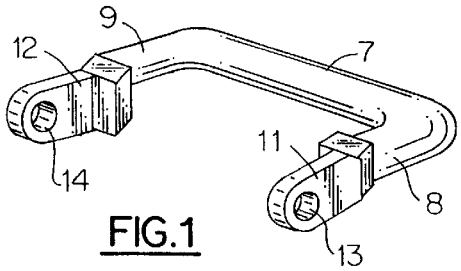
FIG.1
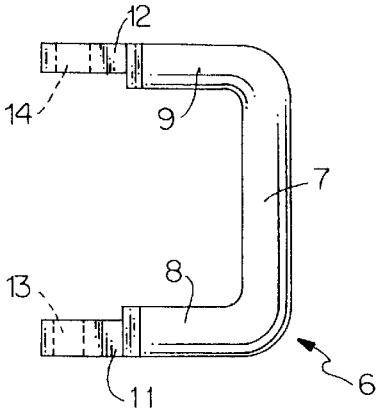
FIG.2
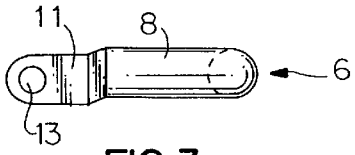
FIG.3
FIG.4
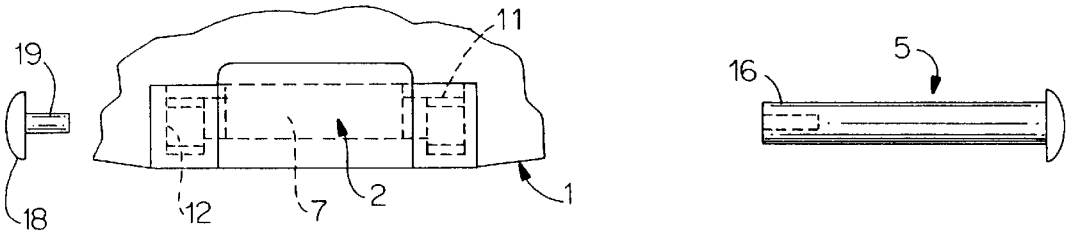
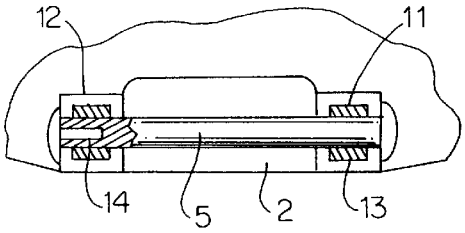
FIG.5

FIG 17
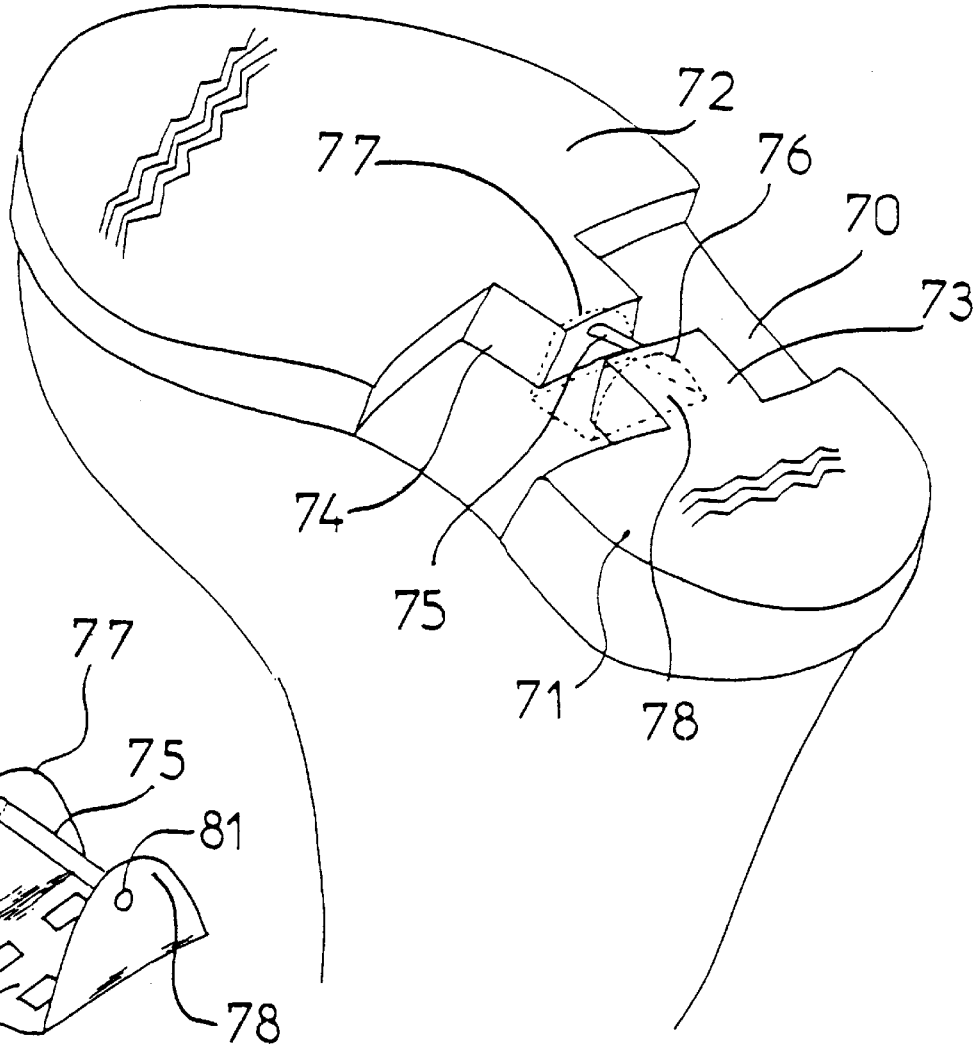
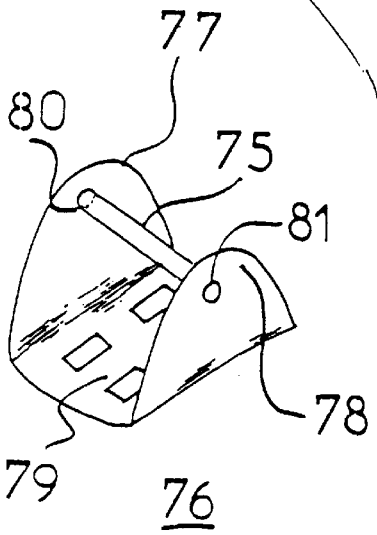
FIG 18

FOOTWEAR WITH A RELEASABLE PIN FOR USE IN GLIDING SPORTS

TECHNICAL FIELD

The invention relates to the field of boots intended for participation in gliding sports such as cross-country skiing, ice-skating or roller-skating, snowboarding, etc. It relates more specifically to the boots which are to interact with the gliding member proper by means of a metal pin located under the sole of the boot. It more specifically takes advantage of the means of fixing this pin to the boot. In the remainder of the description, attention will more particularly be devoted to the use of the invention in cross-country skiing, but it must be kept in mind that a person skilled in the art will be readily able to transpose it to other sports such as skating or boarding.

PRIOR ART

As is known, a cross-country ski boot is composed of an upper intended to cover the foot and of a sole connected to the binding and/or the top face of the ski.

Near the front end, the sole has a transverse pin intended to be caught by the binding secured to the ski. It is becoming increasingly common for high-performance boots to have one or more longitudinal grooves under the sole. These grooves interact with complementary ridges on the ski or, more generally, on the binding. In general, the main groove is deeper at the front of the sole in order to house the binding pin. The latter connects between the two vertical sides of the groove.

As is known, this pin extends deeply into the sole to give an effective anchor. This is necessary because during jolts and when the ski is flying, the pin is subjected to high stresses and needs to be firmly attached to the sole in order to prevent it from pulling out.

To improve the anchorage, it has been proposed for the extensions of the pin to be connected to a metal plate embedded in the material of the sole when it is being manufactured by moulding, towards the rear of the boot.

Quite clearly, moulding the sole requires particular precautions and special tooling to allow the sole to be moulded encompassing the two ends of the transverse pin, while leaving this pin visible. Unfortunately, even though these special procedures are compatible with overmoulding the sole directly to the upper, they require very expensive so-called "slide" moulds because of the undercut formed by the transverse pin. Soles obtained independently are therefore bonded to the upper afterwards. It then follows that the cost price of a boot of this type is still high because sophisticated moulding machines and a significant amount of labour must be used.

The same drawbacks inherent in the moulding of the sole are observed, for example, with snowboarding boots or skates.

SUMMARY OF THE INVENTION

The object of the invention is to provide a design of that region of the boot that has the metal pin which allows easy moulding, avoiding the use of special tooling while at the same time retaining a high anchorage capability.

Thus, the boot in accordance with the invention is of the type comprising a sole the underside of which has a recess delimited by two more or less vertical walls pointing towards the bottom of the boot, the said recess having passing through it a pin which is intended to interact with means for attaching to the gliding member and comprising a rigid piece embedded in the sole and having two extensions extending into the said walls and intended to accommodate the said pin.

This boot is characterized in that the extensions and the ends of the pin have means intended to make this pin removable.

In other words, the metal pin is removable and is secured to the boot for example by being screwed to a piece embedded within the sole. This embedded piece constitutes the anchoring points for the pin.

The invention therefore consists in using an anchoring piece and a pin which are separate, the anchoring piece being at least partially embedded during the moulding of the sole so that it does not form any undercut.

In this way, the moulding tools are simple, and this in particular allows the sole to be moulded directly on the upper.

In a first embodiment, the embedded rigid piece is a U-shaped stirrup piece, the opening of which points towards the metal pin and the legs of which form the extensions which are intended to accommodate the characteristic pin.

In practice, the rear portion of the U-shaped stirrup piece is situated in a plane more or less parallel to the plane of the underside of the sole of the boot, the front ends of this stirrup piece being arranged in a plane which is also more or less parallel to the plane of the sole, but below the plane of the rear portion of the stirrup piece.

Advantageously, the legs of the said stirrup piece have a discontinuity, the end of each leg being offset downwards with respect to the plane of the stirrup piece. In this way, the ends of the stirrup piece which act as anchoring points for the pin are closer to the underside of the sole, while the anchoring part proper is situated right at the heart of the moulded portion of the front of the boot.

In another embodiment, the embedded metal piece is a plate bent into three portions, namely a first, central, portion, more or less parallel to the sole of the boot, and two lateral portions extending into the side surfaces, these lateral portions being designed to accommodate the transverse pin. This design makes it possible to increase the area of contact between the anchoring piece and the moulded material, and this improves the resistance of the unit as a whole to pulling out.

As regards the catching of the characteristic pin on the boot, a number of embodiments can be envisaged.

Thus, in a first alternative form, the end of the pin, which is for example metal, has a tapped hole into which the threaded shank of a bolt is screwed.

In a second alternative form, the pin has at least one end which is telescopic and retractable, and the two ends of the pin can be housed in housings provided for this purpose in the extensions of the embedded metal piece.

In a third alternative form, the pin may be integral with two hollow sleeves intended to be pushed over visible parts of the extensions of the embedded piece.

Quite obviously, a number of pin geometries and/or cross sections may prove advantageous for use in accordance with the invention. In particular, the pin may be cylindrical but also formed of a strip shaped to suit its purpose.

The provisions in accordance with the invention prove particularly advantageous when manufacturing boots intended for cross-country skiing, and in which the recess is forward of the metatarsophalangeal joint, the extensions then pointing forwards.

As a side issue, the invention makes it possible to solve the problem with wear on the front part of the boot, where repeated contact with the binding causes deformation and even sometimes breakages. For this, the front end of the sole which corresponds to the region of wear can be detached from the boot. It has housings that complement the lateral extensions of the metal piece to allow it to be pushed on, and perforations to allow the transverse pin to pass.

In another embodiment, using the anchoring points formed by the extensions of the embedded piece, the boot has a wide longitudinal groove on the underside of the sole. In combination, the boot has a strip attached inside this wide groove, the lowermost face of this attached strip having a profile which complements the region of the ski and/or of the binding on which it rests. Furthermore, the boot also towards the rear of said wide groove, has means of anchoring the rear of the said attached strip, the front part of the attached strip being anchored by the extensions of the embedded metal piece in combination with the transverse pin.

With this arrangement it is therefore easy, starting from a common boot, to make various versions intended to be adapted to suit various shapes of binding. This design proves particularly advantageous as regards the various types of groove and rib that there are on the underside of the soles of cross-country ski boots.

The arrangements in accordance with the invention may also prove advantageous when producing boots intended for snowboarding, where the recess is then at the instep and the extensions of the embedded piece point downwards, the pin being along the longitudinal plane of the boot.

These arrangements may also advantageously apply when producing boots intended for ice- or roller-skating, where the sole has arrangements liable to allow the blade or roller support plate to be secured by means of the metal pin and the extensions of the embedded piece.

BRIEF DESCRIPTION OF THE DRAWINGS

The way in which the invention can be produced, and the advantages that stem therefrom, will emerge clearly from the description of the embodiment which follows, supported by the appended figures.

FIG. 1 is an outline perspective view of a stirrup piece in accordance with the invention, showed viewed from above in FIG. 2 and viewed from the side in FIG. 3.

FIGS. 4 and 5 are front views of the front recess in the sole, showing the pin when it is dismantled from, and respectively mounted in, the stirrup piece.

FIG. 17 is an outline perspective view of the sole of a snowboarding boot in accordance with the invention.

FIG. 18 is a detail view of an embedded piece in accordance with the invention, in the case of a snowboarding boot.

Figure 6:
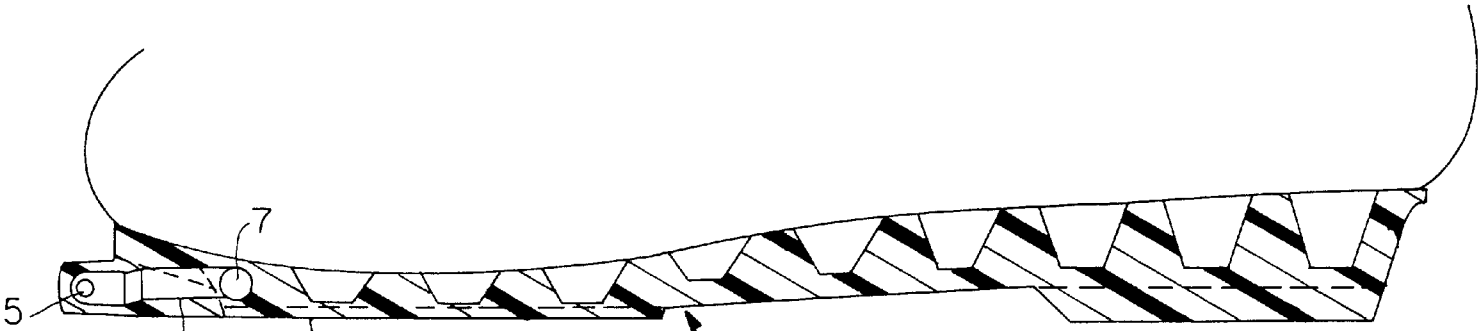
FIG. 6 is a longitudinal section through the sole equipped with the device in accordance with the invention.
Figure 7:
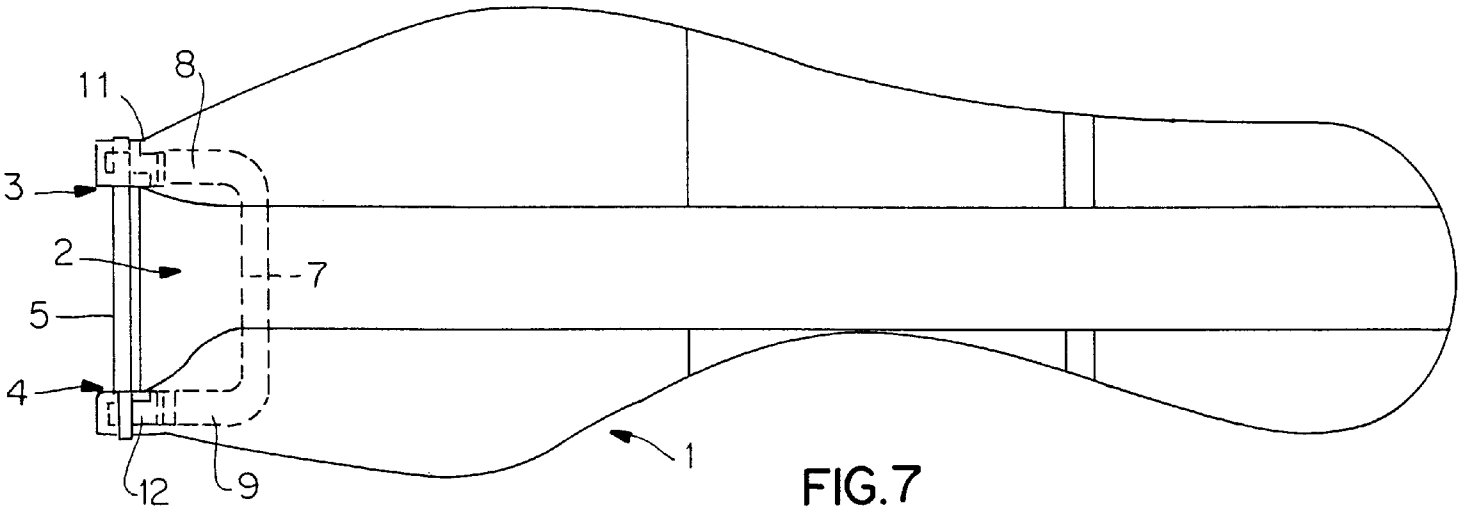
FIG. 7 is a view of the same sole, from below.

In the remainder of the description, it will be assumed that the boots described are lying flat, which means that the underside of the sole is horizontal.

DESCRIPTION OF THE INVENTION

As already stated, the invention relates to boots for gliding sports, especially cross-country skiing.

As is known, a cross-country ski boot is composed mainly of an upper and of a sole (1) in which the arrangements inherent to the invention are more particularly located.

As is known, cross-country ski boots have a recess (2) in the front part of the sole, around the mid plane and which has an opening towards the front and towards the underside of the sole. The lateral walls (3, 4) of this recess (2) consist of two more or less vertical portions forming the bearing surfaces for a transverse pin (5).

The novel feature of the invention lies in the way in which the pin is attached to the sole (1).

In contrast to all existing boots, the boot in accordance with the invention has a pin which is secured to the sole after the sole has been moulded. For this, in its front part, the sole has an embedded piece (6) which constitutes the anchoring points for the pin (5). In the embodiment illustrated in FIGS. 1 to 6, the embedded piece (6) is in the form of a U-shaped stirrup piece. The base (7) of this stirrup piece (6) constitutes a transverse bar which is embedded within the sole, at the first toe phalanx. The length of this bar (7) slightly exceeds the width of the recess (2). The legs (8, 9) of the stirrup piece (6) point forwards, and are directed slightly downwards to prevent the leg (7) of the stirrup piece (6) from passing through the central groove in the sole. The ends (11, 12) of the legs (8, 9) are intended to accommodate the transverse pin (5). For this, these ends have holes (13, 14) pierced transversely and opposite one another.

In the alternative form illustrated in FIG. 4, the end of the pin has a tapped hole (16) into which the threaded shank (19) of the bolt (18) is screwed.

Of course, it would not be departing from the scope of the invention if any method that allowed effective attachment were used to attach the pin (5), i.e. for example, a tapping in one of the holes (13, 14) into which the threaded end of the pin (5) could be screwed.

Figure 15:
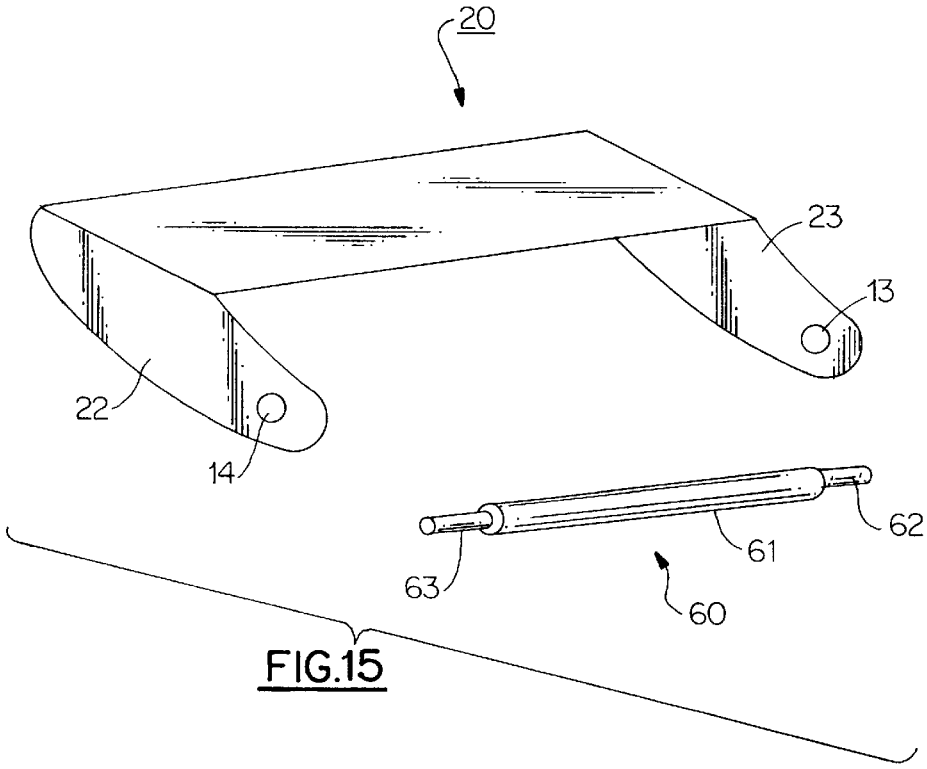
FIGS. 15 and 16 are outline perspective views illustrating two alternative forms of the attachment of the pin to the moulded piece.

In the alternative form illustrated in FIG. 15, the pin (60) consists of a hollow body (61) inside which two coaxial pegs (62, 63) can slide. A return member (not depicted) of the coil spring type keeps these pegs (62, 63) in the deployed position, and opposes their retraction into the body (61). The pin (60) is fitted between the extensions (22, 23) of the embedded piece (20) by pushing the pegs (62, 63) into the body (61) stressing the return member (not depicted). Then, once this pin (60) is precisely positioned between the holes (13, 14) in the piece (20), the pegs (62, 63) are released and become housed in the holes (13, 14).

Figure 16:
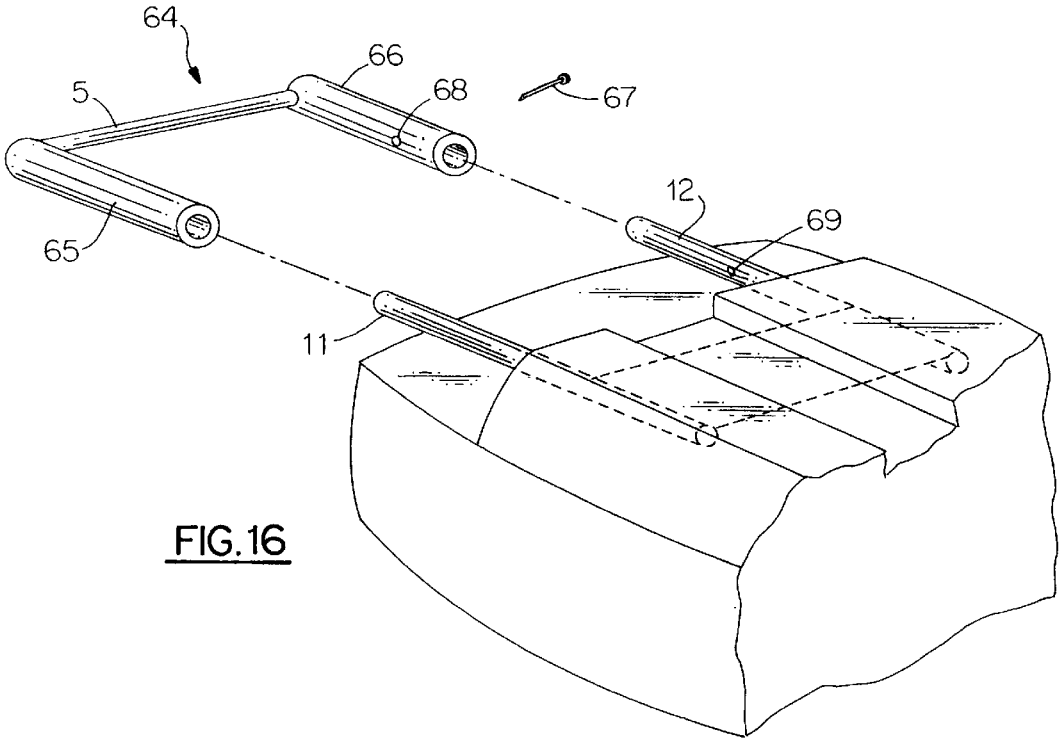

In another embodiment illustrated in FIG. 16, the pin (5) is secured to hollow tubes (65, 66) so that it forms a stirrup piece (64). This stirrup piece (64) can be pushed onto the extensions (11, 12) of the embedded metal piece. This stirrup piece (64) is secured by means of pins (67) inserted into the holes (68 and 69) in the tube (66) and in the extension (12) of the piece embedded within the sole, respectively.

To optimize the anchorage of this stirrup piece, the legs (8, 9) have a discontinuity which means that their ends (11, 12) are offset slightly downwards so that the bar (7) is embedded as deeply as possible within the sole, to avoid it from passing through the central rib.

Furthermore, these ends (11, 12) are not as thick as the central bar (7) because they are machined to have flat surfaces, particularly to allow them to be positioned in the mould.

During the moulding of the sole (1), the stirrup piece (6) is positioned in such a way that the bearing surfaces (3, 4) are moulded around the ends (11, 12) of the stirrup piece. It is held within the sole during moulding by any means known in the field of moulding, such as centring stakes for example. After moulding, all that is required is for the walls (3, 4) to be pierced at the holes (13, 14) in order to obtain the passage for the pin (5). The stirrup piece could also be moulded by fitting the said holes (13, 14) with removable pieces to avoid subsequent piercing.

In an alternative form, the opposing internal faces of the legs (11, 12) may be tangential to the mould insert which then acts as a centring device.

As can be seen, the sole of a boot in accordance with the invention can be distinguished fundamentally from all existing boots by the fact that the sole is moulded without any metal pieces forming a bridge, which makes this moulding operation far easier by dispensing with undercuts.

Figure 8:
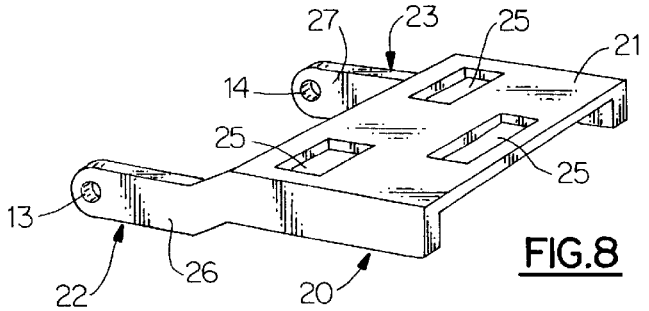
FIG. 8 is an outline perspective view of an alternative form of the piece embedded in the front of the sole.

In an embodiment shown in FIG. 8, the embedded piece (20) comes from bending a metal sheet into three portions (21, 22, 23). The central portion (21) is intended to be embedded in the material of the front of the sole. It has holes (25) allowing the plastic to spread out during moulding. The large area of a portion (21) of this kind allows effective anchorage. This portion (21) has bent lateral extensions (22) and (23), the front ends (26) and (27) of which are offset slightly downwards and have holes (13) and (14) for attaching the pin (5).

Figure 9:
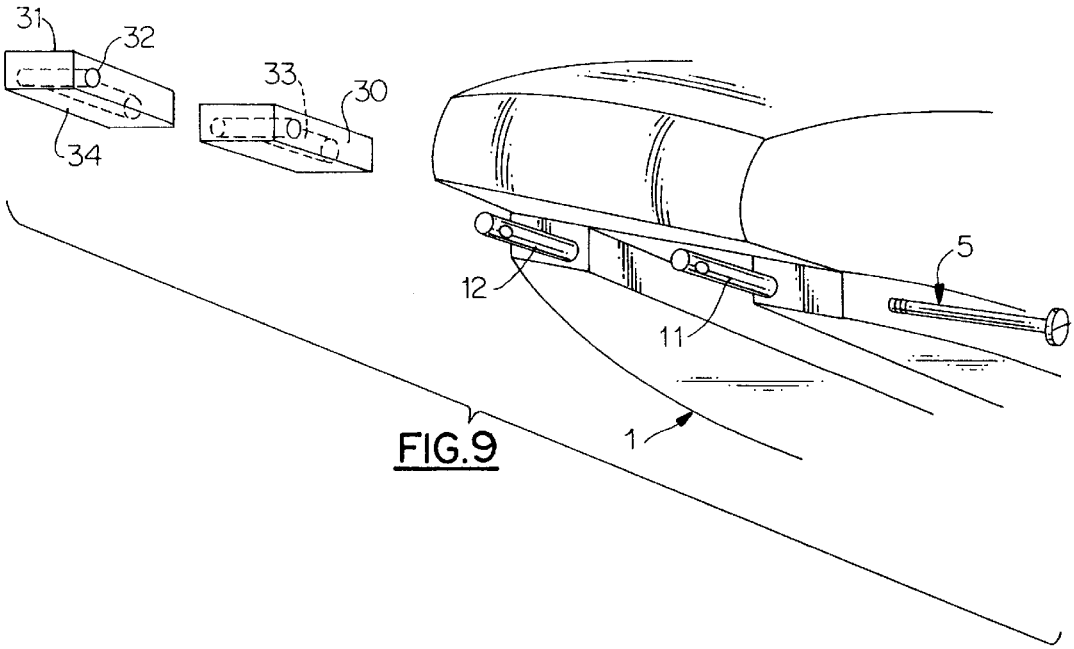
FIG. 9 is an exploded outline perspective view of one embodiment of the invention, with removable wearing pieces.

As can be seen in FIG. 9, the portions (30, 31) of the walls (3, 4) are advantageously mounted extractably on the ends (11, 12) of the stirrup piece (6). This region of the boot is the part where the most wear takes place because it is at the lower front edge of the sole. It therefore rubs directly on the binding and forms one of the regions which is most exposed when walking. These extractable portions (30, 31) have longitudinal drillings (33, 34) allowing them to be pushed onto the ends (11, 12) of the stirrup piece (6). These portions (30, 31) also have a transverse drilling (32) allowing the passage of the pin (5) which will catch on the ends (11, 12) of the stirrup piece and thus attach the wearing pieces (30, 31).

Of course it would not be departing from the scope of the invention if these wearing pieces were given any advantageous shape that could be secured to the visible portions of the stirrup piece (6). In particular, these wearing pieces could form one single portion.

Of course, the anchoring points mentioned hereinabove can also be used for attaching some other piece to the sole (1).

As is known, in the field of cross-country skiing, there are two major standards that define the structure and design of the underside of the sole. In a first standard, generally denoted "NNN", the sole (1) has two longitudinal parallel grooves placed symmetrically about the mid-plane of the boot. In another standard, denoted "SNS", the sole has a single, wider, groove arranged along the longitudinal axis. This or these groove(s) are intended to interact with corresponding rails situated on the ski or on the bindings.

By adding a small-sized piece, a common boot can be adapted to suit one of these two standards.

Figure 10:
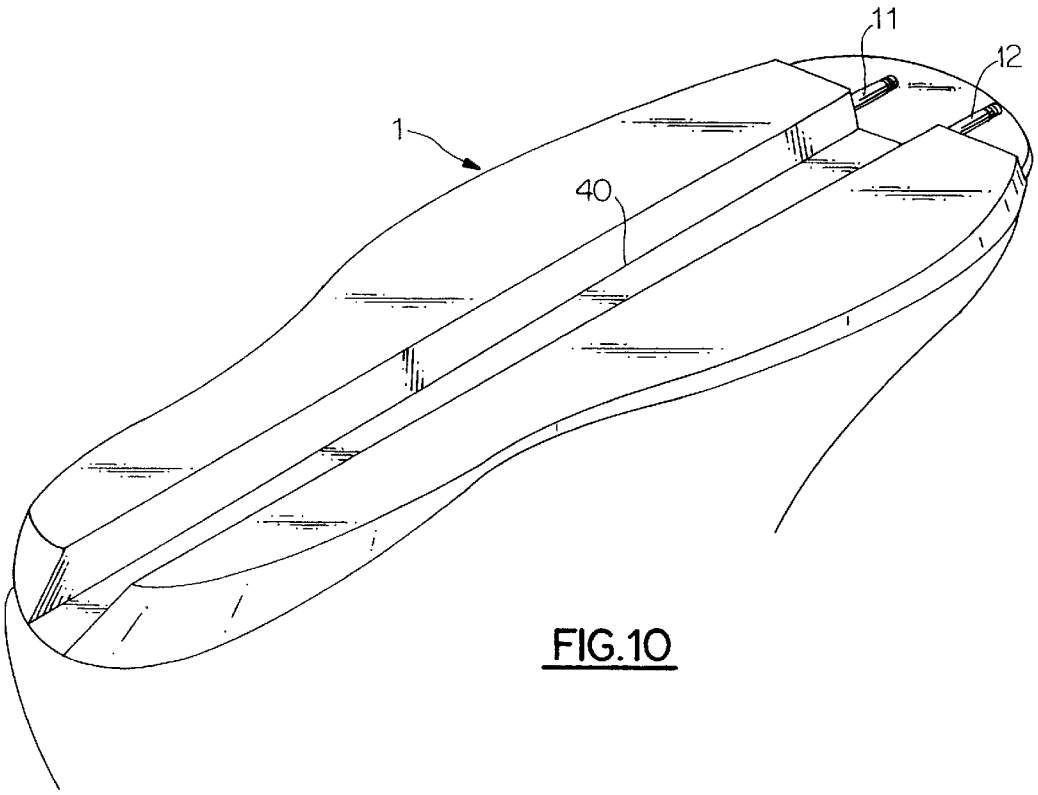
FIG. 10 is an outline perspective view of the underside of a sole which has a wide groove capable of accommodating the profiled strips shown in FIGS. 11 and 12.
Figure 12:
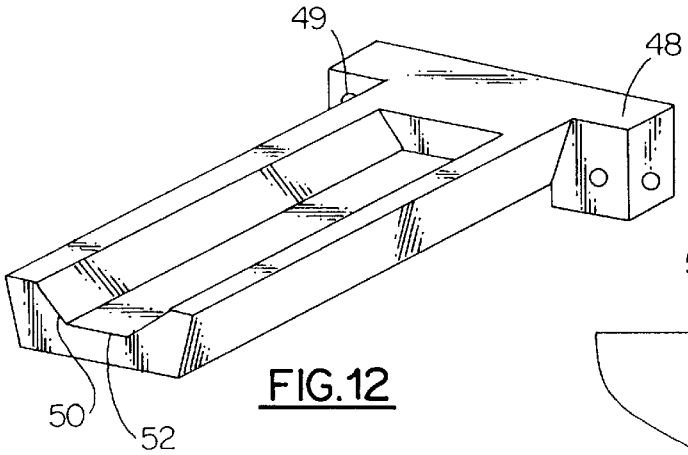
Figure 11:
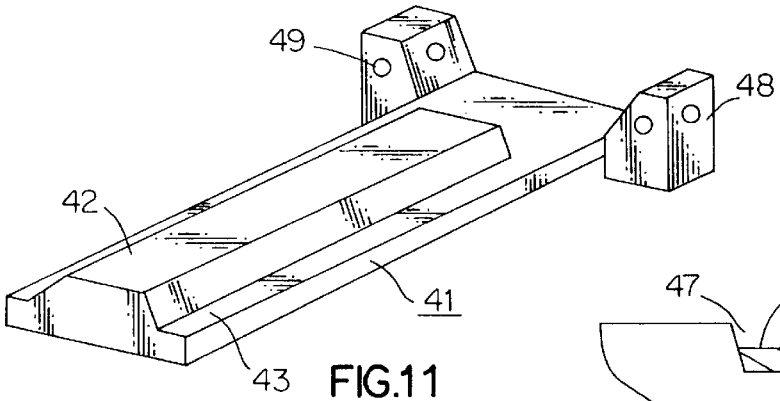

As shown in FIGS. 10, 11, 12, this common boot has a wide groove (40) situated along the longitudinal axis of the sole (1). The dimensions of this wide groove (40) are sufficient to accommodate a strip (41) which has two thinner parts (43) and a central rib (42). When this strip (41) is inserted inside the wide groove (40), the lateral slopes of this groove define, with the flat portions (43) and the rib (42), two grooves (47) which are placed symmetrically with respect to the longitudinal axis of the boot.

Figure 13:
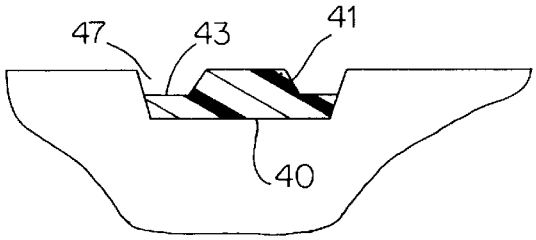

Thanks to wings (48) with holes (49) in, this strip (41) can be slipped at the front into the ends (11, 12) of the stirrup piece (6) for attaching the pin (5). The strip has means (not depicted) allowing it to be attached to the rear end of the sole. The profile thus obtained corresponds to the one described earlier for the "NNN" standard (see FIG. 13).

Figure 14:
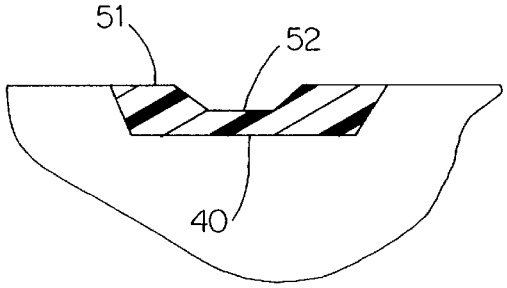
FIGS. 13 and 14 are cross sections showing the integration of the strips of FIGS. 11 and 12 into the sole.

The profile depicted in FIG. 12 has a strip (50) which along its longitudinal axis has a central groove (52) to the dimensions laid down in the "SNS" standard. As before, inserting this strip makes it possible to form on the underside of the sole a groove which has the dimensions laid down in said standard (see FIG. 14).

The operation of mounting an additional rib as described hereinabove can easily be substituted, in a way which is obvious to a person skilled in the art, by the attachment on the underside of the sole of a plate which, on its underside, has an ice-skating blade or a line of rollers.

As already stated, the arrangements in accordance with the invention may prove advantageous when producing soles for snowboarding shoes in which, as illustrated in FIG. 17, there is a recess (70) at the instep between the heel region (71) and the front part (72) of the sole. Thus, in this housing (70) more or less at the middle, there are two bearing surfaces (73, 74) between which the pin (75) for interacting with the binding (not depicted) is located.

In accordance with the invention, the sole accommodates an embedded piece (76) drawn in dotted line. This piece (76), illustrated in FIG. 18, consists of a bent plate, of which the central part (79), which is advantageously perforated, is parallel to the horizontal plane of the sole and of which the end parts (77, 78) form the extensions extending into the bearing surfaces (73, 74). These extensions (77, 78) have pierced holes (80, 81) intended to accommodate, removably, and according to the various alternative attachment forms described hereinabove, the pin (75) that interacts with the binding. In this instance, for fitting the pin in the recess, it may prove advantageous to use a pin with retractable ends, like the one illustrated in FIG. 15.

Figure 19:
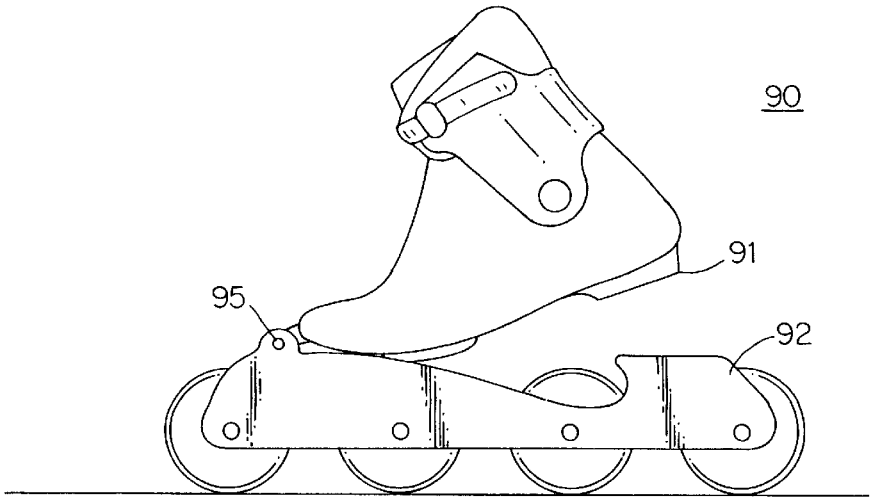
FIG. 19 is a side view of an in-line roller skate in accordance with the invention.

As already stated, the invention can also be used for manufacturing boots intended for skating. Thus, as illustrated in FIG. 19; the boot (90) at the front has an embedded piece (not depicted) intended to accommodate the transverse pin (95). This pin (95) allows the plate (92) supporting the rollers to be attached temporarily.

It emerges from the foregoing that cross-country ski boots, skating boots or snowboarding boots in accordance with the invention have a main advantage which lies in the fact that the boot can be moulded without a visible pin, and this considerably simplifies the moulding equipment, avoiding devices with slides, and that advantageously allows the sole to be produced directly on the upper.

The characteristic use of this embedded piece creates robust anchoring points, and this allows special adaptor pieces or wearing pieces to be pushed on.

What is claimed is:

1. A sport boot for interacting with a gliding member, said sport boot having an upper portion and a sole, wherein the sole is molded to the upper portion such that said boot includes a recess that passes inwardly through the front of said sole, said recess having two parallel vertical side walls;

a stirrup means embedded in said sole, said stirrup having a pair of extensions that extend into the parallel vertical side walls of said recess;

said extensions having receiving means for receiving a removable pin which is capable of being securely fitted into said extensions and securing means for retaining the pin in said extensions.

2. The boot of claim 1 wherein said stirrup is a U-shaped member having a base from which a pair of legs extend outwardly for receiving said pin therein.

3. The boot of claim 2 wherein said base is molded in the sole and aligned in parallel with the bottom of the sole means and said legs are canted downwardly from said base.

4. The boot of claim 3 wherein said legs each have a front piece that is offset downwardly with respect to the plane of said base.

5. The boot according to claim 1 wherein said stirrup means includes a plate that is bent into three sections, a first central section that is parallel to the sole of the boot and two lateral side sections that extend into the side walls of the recess, said side sections having receiving means therein for removably receiving said pin.

6. The boot of claim 1 wherein said pin is slidably received in holes formed in said extensions, said pin having an expanded head at one end and an expanded headed screw threaded into the other end thereof to prevent the pin from passing out of said holes.

7. The boot according to claim 1 wherein the pin has at least one end piece that is slidably received in the body of the pin for axial movement whereby the pin is retractable into the body to facilitate mounting of the pin in the extensions.

8. The boot of claim 1 wherein said pin is mounted in two parallely aligned hollow sleeves that are perpendicularly disposed with respect to the pin, said sleeves being arranged to be slidably received over members contained in the extension of the stirrup.

9. The boot of claim 1 wherein said recess is located forward of the metatarsophalangeal joint region and the extensions of the stirrup are forwardly disposed.

10. The boot of claim 9 wherein the front end of the sole contains removable opposed wear housings that complement the contour of the extensions of the embedded stirrup whereby said wear housings can be slidably received on said extensions, said wear housings further including means for receiving said pin therein.

11. The boot of claim 9 that further includes a wide longitudinally disposed groove on the underside of the sole;

a strip mounted inside said groove having a contoured outer face that complements a region on a ski, anchoring means for anchoring the rear of said strip to the sole, and the front of said strip being anchored by the extensions of said stirrup and said pin.

12. The boot of claim 1 wherein said pin is arranged to engage a plate of a skate to attach the skate to the boot.

13. A sport boot for interacting with a gliding member that includes:

sole means on the bottom of the boot having a recess that passes inwardly through the front of the sole, said recess containing two spaced apart vertical side walls;

a stirrup means mounted in said recess that is embedded in said sole, said stirrup having a pair of spaced apart extensions that extend into the side walls of said recess;

said extensions having receiving means for removably receiving therein a pin;

securing means for removably retaining the pin in said extensions, wherein said stirrup is a U-shaped member having a base from which a pair of legs extend outwardly for receiving said pin therein; and wherein said base is embedded in the sole and parallely aligned with the bottom of the sole means and said legs are canted downwardly from said base.

* * * * *